US010096947B2

(12) United States Patent
Cheng et al.

(10) Patent No.: US 10,096,947 B2
(45) Date of Patent: Oct. 9, 2018

(54) ELECTRICAL CONNECTOR AND ELECTRICAL DEVICE ASSEMBLED WITH THE SAME THEREIN

(71) Applicant: FOXCONN INTERCONNECT TECHNOLOGY LIMITED, Grand Cayman (KY)

(72) Inventors: Chih-Pi Cheng, New Taipei (TW); Ming-Lun Szu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/487,405

(22) Filed: Apr. 13, 2017

(65) Prior Publication Data

US 2017/0302031 A1 Oct. 19, 2017

Related U.S. Application Data

(60) Provisional application No. 62/333,161, filed on May 7, 2016.

(30) Foreign Application Priority Data

Apr. 13, 2016 (CN) ..... 2016 1 0225997
May 10, 2016 (CN) ..... 2016 1 0304625

(51) Int. Cl.
*H01R 13/648* (2006.01)
*H01R 13/6581* (2011.01)
(Continued)

(52) U.S. Cl.
CPC ..... *H01R 13/6581* (2013.01); *H01R 12/716* (2013.01); *H01R 13/6596* (2013.01);
(Continued)

(58) Field of Classification Search
CPC .... H01R 2107/00; H01R 43/18; H01R 24/64; H01R 13/6596; H01R 12/716; H01R 13/6581
(Continued)

(56) References Cited

U.S. PATENT DOCUMENTS 9,093,779 B1 7/2015 Wang et al.
2008/0188130 A1* 8/2008 Buschle ..... H01R 12/721 439/607.41
(Continued)

FOREIGN PATENT DOCUMENTS

CN 103035266 A 4/2013
CN 104518346 A 4/2015
(Continued)

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

An electrical connector includes an insulative housing, a number of terminals retained in the insulative housing and a shell surrounding around the insulative housing. The insulative housing includes a base and a mating tongue extending forwardly therefrom. The mating tongue includes two opposite mating faces and two opposite side faces. The shell includes a holding portion and a mating portion. The mating portion of the shell includes two short-walls facing to the two side faces of the mating tongue and at most a long-wall facing to one of the mating faces of the mating tongue so that at least one of the mating faces of the mating tongue could be exposed to exterior in a vertical direction.

19 Claims, 27 Drawing Sheets

(51) Int. Cl.

| | |
|---|---|
| ***H01R 43/18*** | (2006.01) |
| ***H01R 13/6596*** | (2011.01) |
| ***H01R 12/71*** | (2011.01) |
| ***H01R 24/64*** | (2011.01) |
| *H01R 107/00* | (2006.01) |

(52) U.S. Cl.
CPC ..... *H01R 24/64* (2013.01); *H01R 43/18* (2013.01); *H01R 2107/00* (2013.01)

(58) Field of Classification Search
USPC ..... 439/76.1, 676, 660, 108, 217
See application file for complete search history.

(56) References Cited

U.S. PATENT DOCUMENTS

2015/0087189 A1* 3/2015 Zhang ..... H01R 13/41 439/676
2015/0140868 A1* 5/2015 Do ..... H01R 24/62 439/676
2015/0244111 A1 8/2015 Ju et al.
2015/0295362 A1* 10/2015 Tziviskos ..... H01R 13/6581 439/607.01
2015/0372424 A1* 12/2015 Little ..... H01R 13/642 439/217
2016/0099524 A1* 4/2016 Hack ..... H01R 13/6583 439/607.55
2017/0077652 A1* 3/2017 Chen ..... H01R 13/405

FOREIGN PATENT DOCUMENTS

| | | |
|---|---|---|
| CN | 204315776 | 5/2015 |
| CN | 204441556 | 7/2015 |
| CN | 104836051 A | 8/2015 |
| CN | 204651582 U | 9/2015 |
| CN | 204696302 | 10/2015 |
| CN | 204760596 U | 11/2015 |
| CN | 105356109 A | 2/2016 |
| CN | 105470782 | 4/2016 |
| CN | 205159614 U | 4/2016 |

* cited by examiner

ELECTRICAL CONNECTOR AND ELECTRICAL DEVICE ASSEMBLED WITH THE SAME THEREIN

BACKGROUND OF THE INVENTION

1. Field of the Invention

The present invention relates to an electrical connector and an electrical device assembled with the same therein.

2. Description of Related Art

Universal Serial Bus Type C cable and connector specification was issued on Aug. 11, 2014, disclosing a plug connector mated with a plug connector in two opposite directions. Anyhow, because the Type C connector is expected to replace all similar dimensioned/level I/O connectors, there are other additional applications for such a mated arrangement. Chinese Patent No. CN204651582 discloses an electrical connector having a waterproof metallic shell formed by stamping. The electrical connector is generally used in portable devices, such as mobile phones and tablet PCs. As the portable devices become more and more miniaturized, the metallic shell of the electrical connector with a certain thickness can not be applicable.

Therefore, an improved electrical connector which can reduce the whole thickness of the electrical connector is required.

SUMMARY OF THE INVENTION

Accordingly, an object of the present invention is to provide an electrical connector including an insulative housing, a number of terminals retained in the insulative housing and a shell surrounding around the insulative housing. The insulative housing includes a base and a mating tongue extending forwardly from the base. The mating tongue includes two opposite mating faces and two opposite side faces. The shell includes a holding portion and a mating portion. The mating portion of the shell includes two short-walls facing to the two side faces of the mating tongue and at most a long-wall facing to one of the mating faces of the mating tongue so that at least one of the mating faces of the mating tongue could be exposed to exterior in a vertical direction. The whole thickness of the electrical connector can be reduced because of the shell with at most a long-wall.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
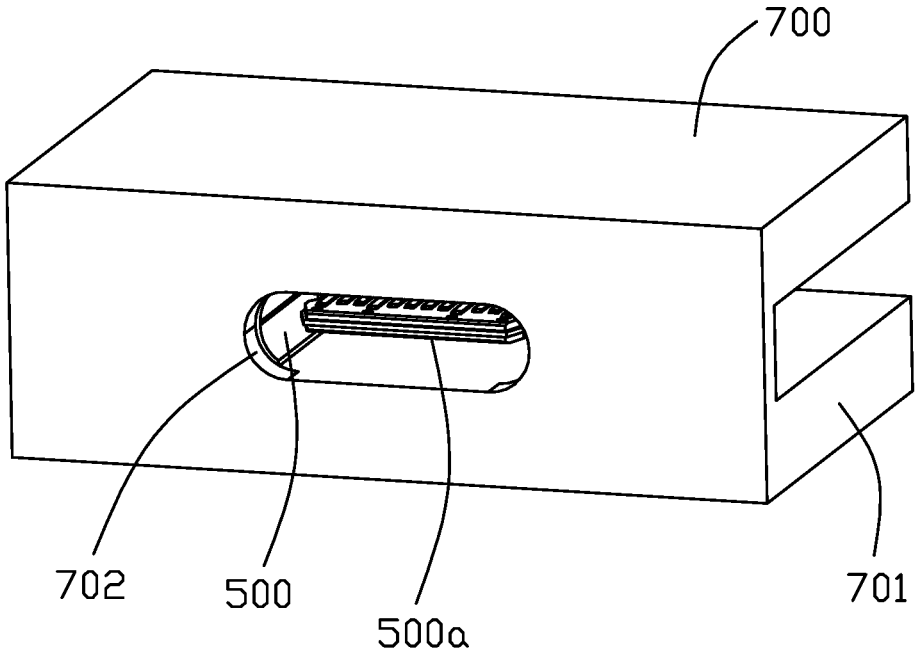
FIG. 1 is a perspective view of an electrical device of the invention which assembled with an electrical connector.
Figure 2:
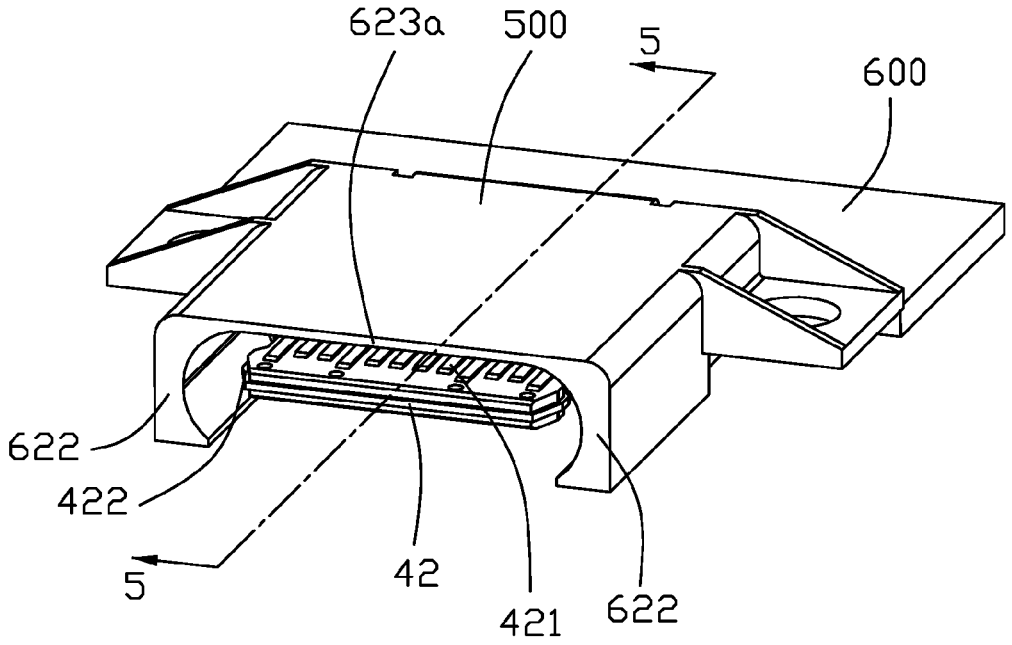
FIG. 2 is a perspective view of the electrical connector mounted on a PCB of FIG. 1.

Referring to FIGS. 1 and 2, an electrical connector 500 mounted on a printed circuit board (PCB) 600 is retained in a shell/case 701 of an electrical device 700. The electrical device 700 defines a mating space 702. A mating portion 500*a* of the electrical connector 500 extends into the mating space 702 for mating with a plug connector.

Figure 5:
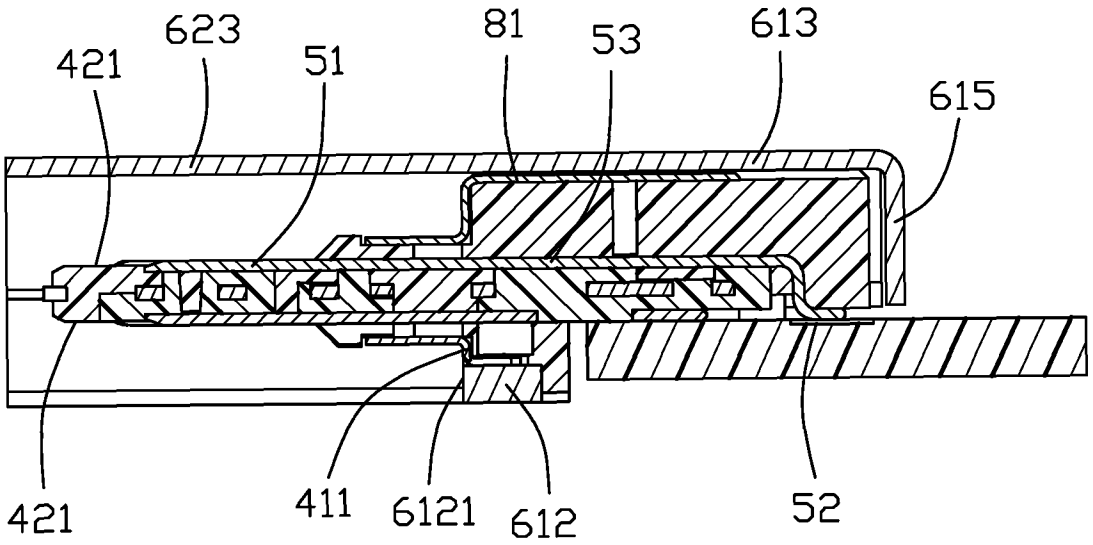
FIG. 5 is a cross-sectional view of the electrical connector and the PCB of FIG. 2.
Figure 6:
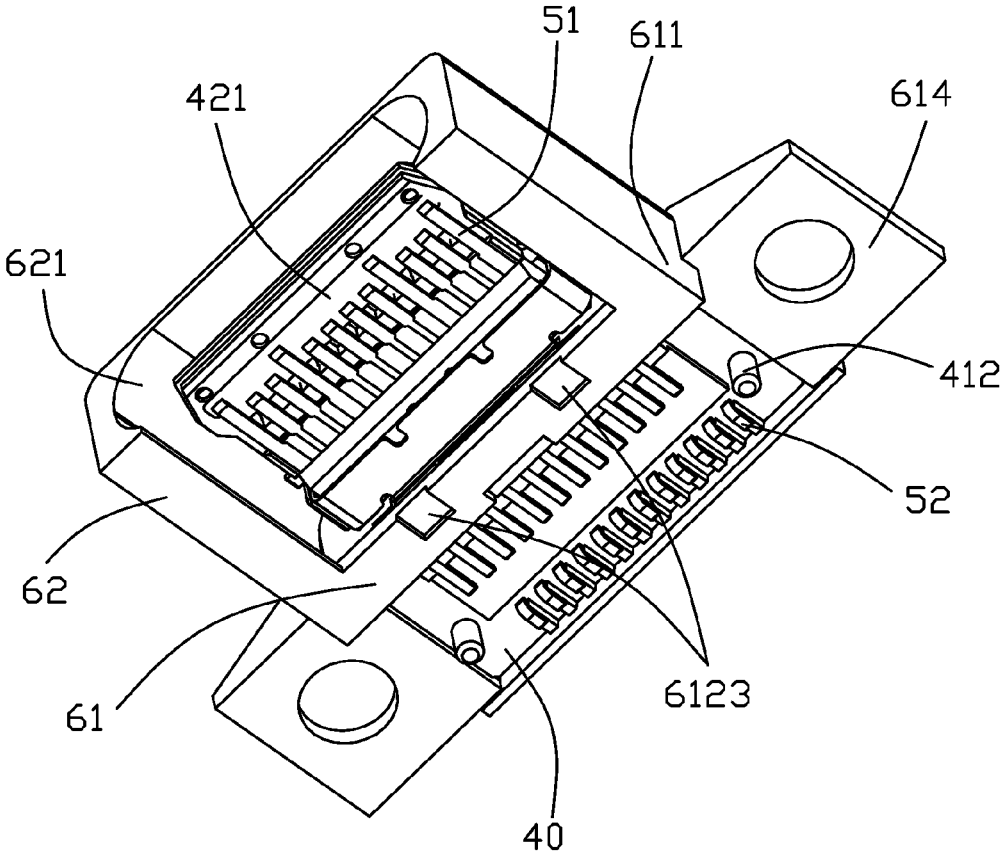
FIG. 6 is a perspective view of the electrical connector of the invention.
Figure 7:
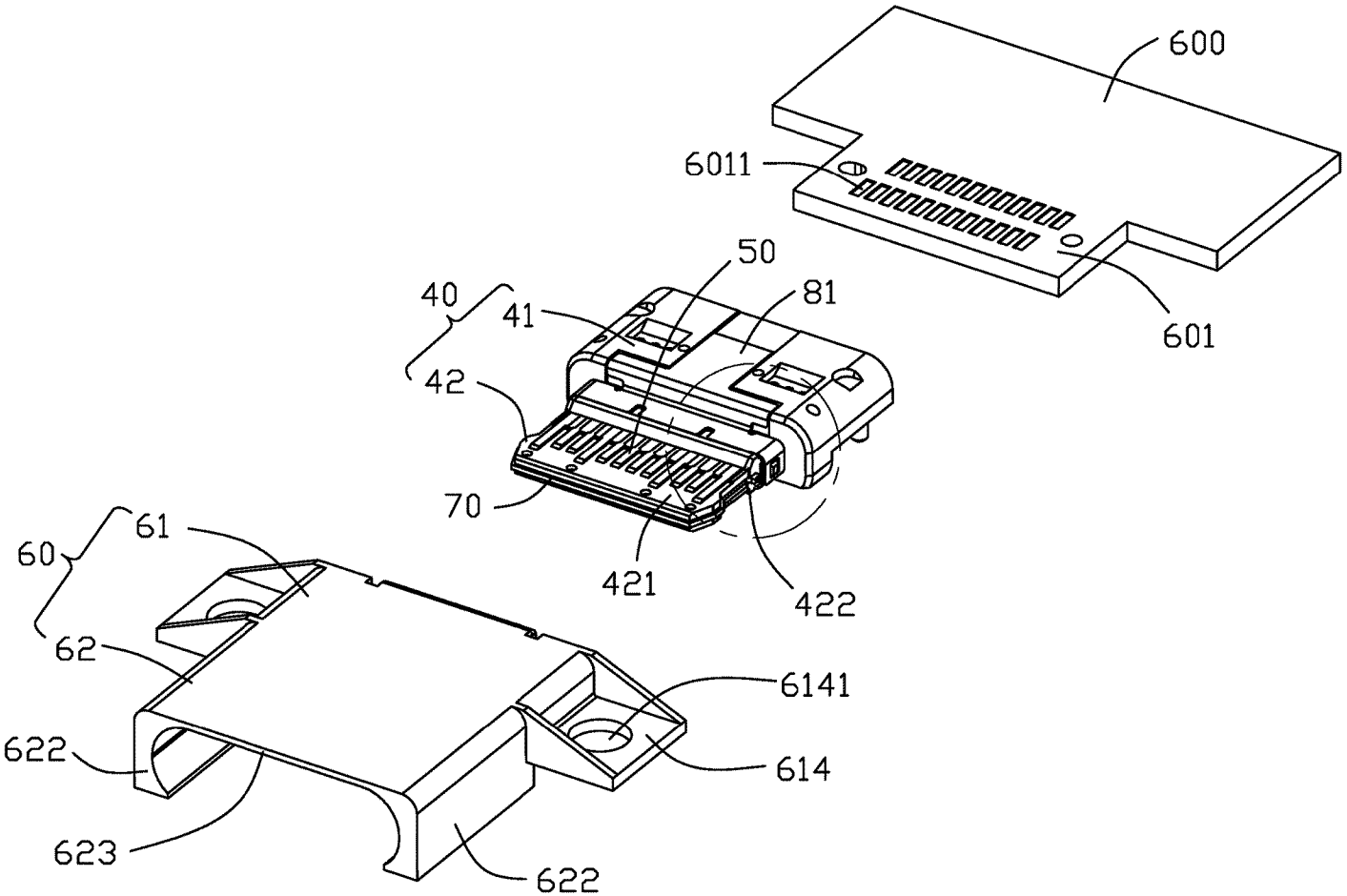
FIG. 7 is an exploded perspective view of the electrical connector and the PCB of FIG. 2.

Referring to FIGS. 5 to 7, the electrical connector 500 includes an insulative housing 40, a plurality of terminals 50 retained in the insulative housing 40, and a shell 60 surrounding around the insulative housing 40. The insulative housing 40 includes a base 41 and a mating tongue 42 extending forwardly from the base 41. The mating tongue 42 includes two opposite mating faces 421 and two side faces 422 connecting therebetween. Each of the terminals 50 includes a contacting section 51 exposed upon the mating faces 421, a tail 52 extending out of the base 41, and a connecting section 53 connecting between the contacting section 51 and the tail 52. The connecting sections 53 of the terminals 50 are retained in the insulative housing 40. The terminals 50 are retained in the insulative housing 40 by a way of insert molding.

Figure 9:
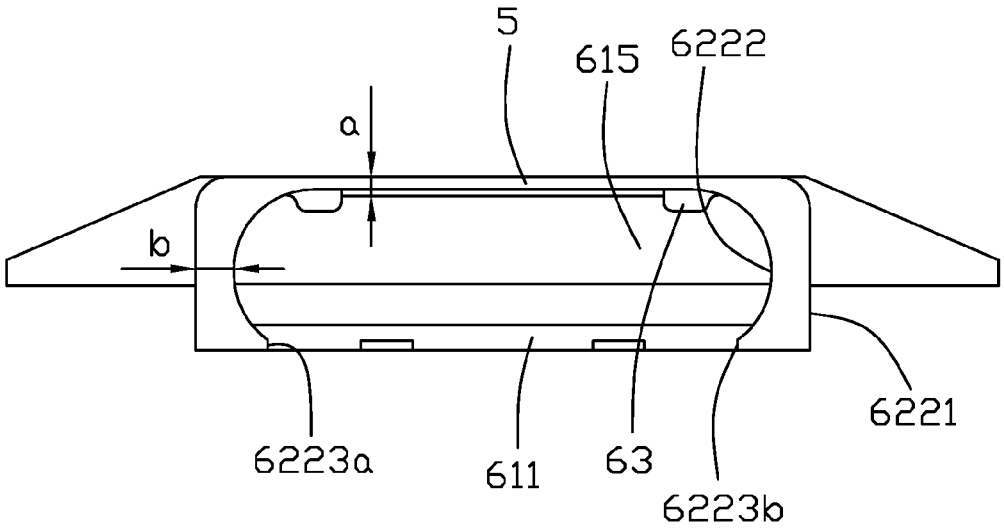
FIG. 9 is a front view of a shell of the electrical connector of FIG. 7.

The shell 60 having a receiving space 621 includes a holding portion 61 retained to the base 41 and a mating portion 62 extending therefrom in a front-to-rear direction. The shell 60 is formed by a way of metal-injection-molding. The shell 60 includes a long-wall 623 and two short-walls 622. Referring to FIG.2, the short-walls 622 face to the two side faces 422 of the mating tongue 42 while the long-wall 623 is located above the mating tongue 42. In this embodiment, the long-wall is located above the mating tongue 42 while the long-wall could be located under the mating tongue 42 in another embodiment. Anyhow, at least one of the mating faces 421 could be exposed outside in a vertical direction because of the electrical connector 500 with at most one long-wall. Both of the two mating faces 421 of the mating tongue 42 are exposed outside because of the shell 60 only having two short-walls 622. Referring to FIG. 9, each of the short-walls 622 has an arcuate interior surface 6222 and a plane exterior surface 6221 perpendicular to the mating faces 421. The thickness of the long-wall 623 is smaller than the thickness of the short-wall 622. When a plug connector inserted into the receiving space 621, the connecting surface between the two free ends 6223*a*, 6223*b* of the two short-walls 622 align to an exterior surface of the plug connector. The shell 60 is formed with a metallic material by a way of die-casting.

Referring to FIGS. 5, 6 and 9, the holding portion 61 includes two short-walls 611 and two long-walls with an upper long-wall 613 and a lower long-wall 612. The lower long-wall 612 has a front face 6121 which is coplanar with a front face 411 of the base 41 in the vertical direction perpendicular to a front-to-rear direction. An exterior surface of the upper long-wall 613 of the holding portion 61 is coplanar with an exterior surface of the long-wall 623 of the mating portion 62. The tails 52 of the terminals are located behind of the lower long-wall 612. A rear wall 615 extends downwardly from a rear edge of the upper long-wall 613 of the holding portion 61 and is soldered to the rear faces of the short-walls 612. Two stopping portions 63 extend downwardly from the junction of the holding portion 61 and the mating portion 62 to prevent the base 41 from moving too much forward.

Figure 3:
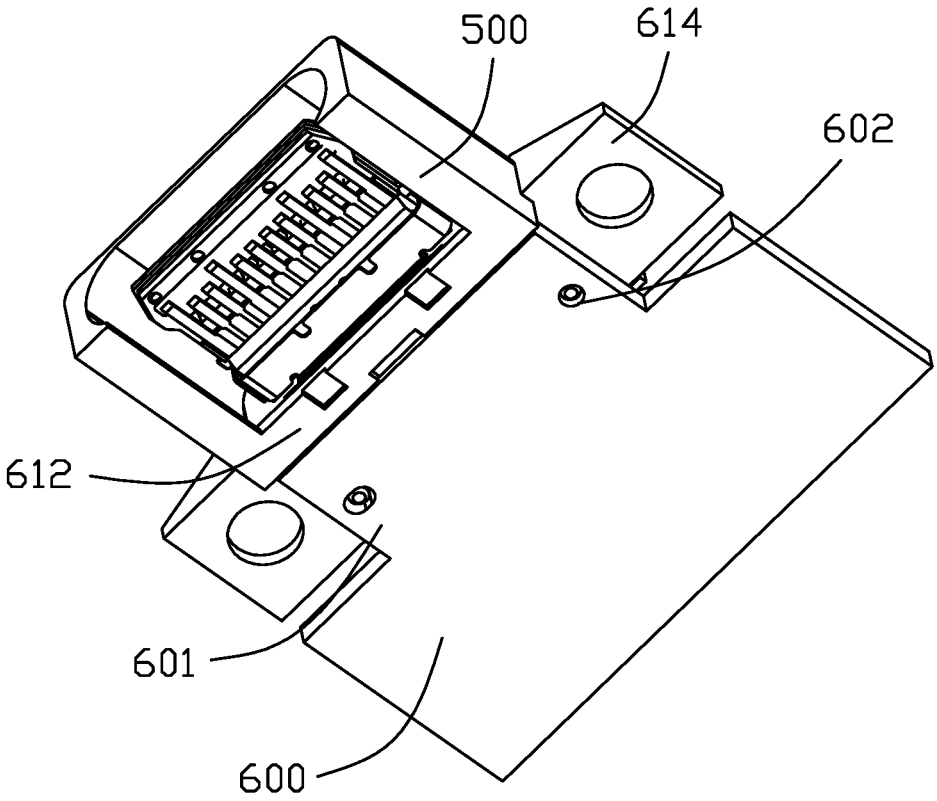
FIG. 3 is an upwardly perspective view of the electrical connector and the PCB of FIG. 2.
Figure 4:
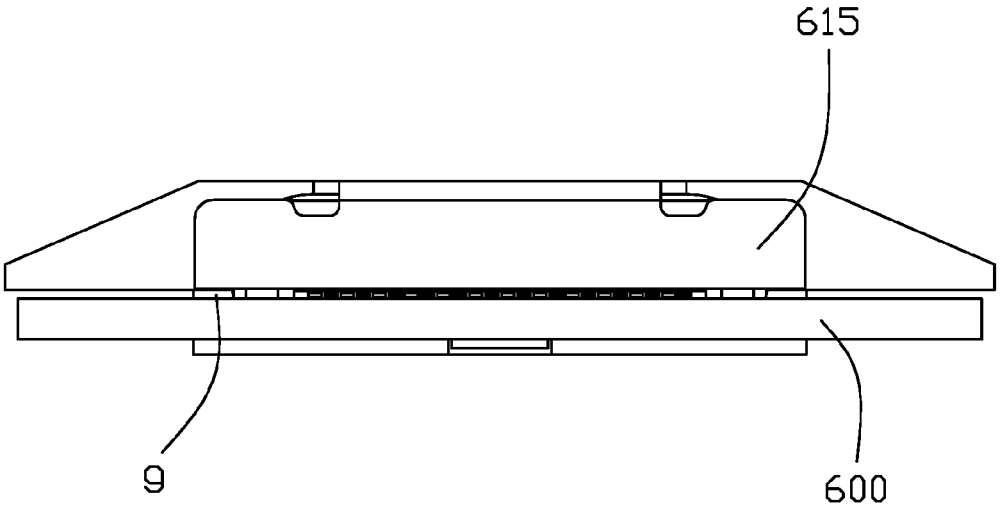
FIG. 4 is a rear view of the electrical connector and the PCB of FIG. 2.

Referring to FIG. 7, each of the two short-walls 611 includes a mounting portion 614 extending in a transverse direction perpendicular to both of the vertical direction and the front-to-rear direction. Each of the mounting portions 614 includes a mounting hole 6141. The printed circuit board 600 includes an extending portion 601 extending forwardly thereof, and the extending portion 601 includes a plurality of conductive pads 6011. Referring to FIGS. 3 and 6, the insulative housing 40 is located between the two mounting portions 614. The tails 52 of the terminals 50 are divided into two rows along the front-to-rear direction. When the electrical connector 500 are mounted to the printed circuit board 600, the extending portion 601 is located between the two mounting portion 614 and abusing against the rear face of the lower long-wall 612. The insulative housing 40 includes two protruding portions 412 extending downwardly from the base 41 and going through two through holes 602, respectively. The tails 52 of the terminals 50 electrically contact with the conductive pads 6011 of the printed circuit board 600, respectively. When the electrical connector 500 and the printed circuit board 600 are mounted to the shell 701 of the electrical device 700, the two mounting portions 614 are mounted to the shell 701 by two bolts. Referring to FIG. 4, a gap (g) is located between the shell 60 and the printed circuit board 600 for a ground connection.

The electrical connector 500 includes a shielding plate 70 retained in the insulative housing 40. The two rows of the terminals 50 are respectively exposed on the two mating faces 421 in the vertical direction. The shielding plate 70 is located between two rows of the terminals 50 in the vertical direction. The shielding plate 70 includes two opposite lateral sides 71 protruding out of the mating tongue 42. The front side of the shielding plate 71 extends outside of the mating tongue 42 to avoid short circuit.

Figure 8:
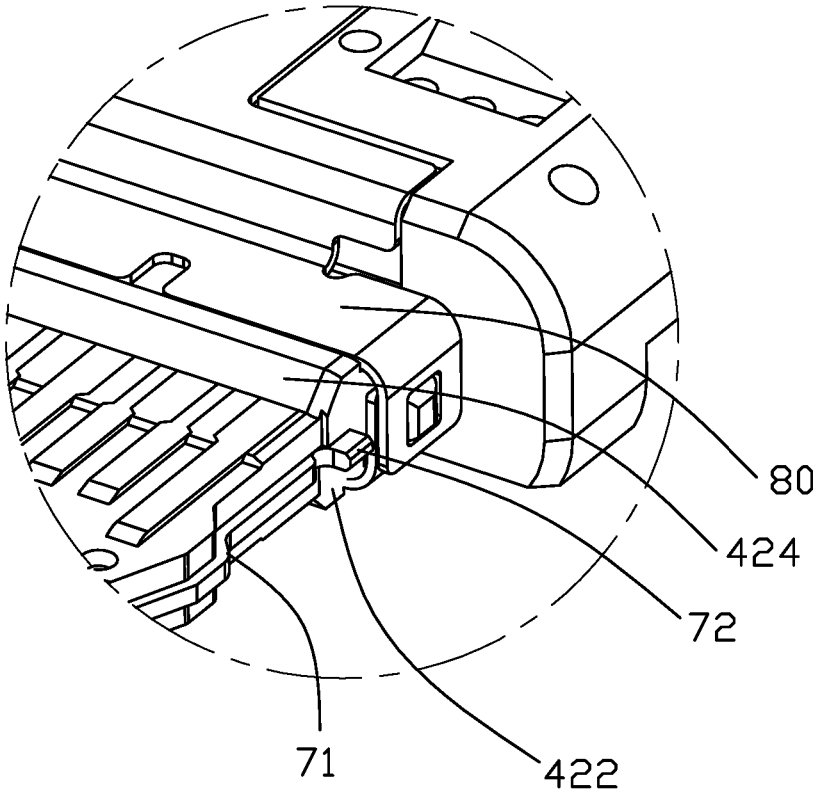
FIG. 8 is a enlarge view of the electrical connector in the circle of FIG. 7.
Figure 10:
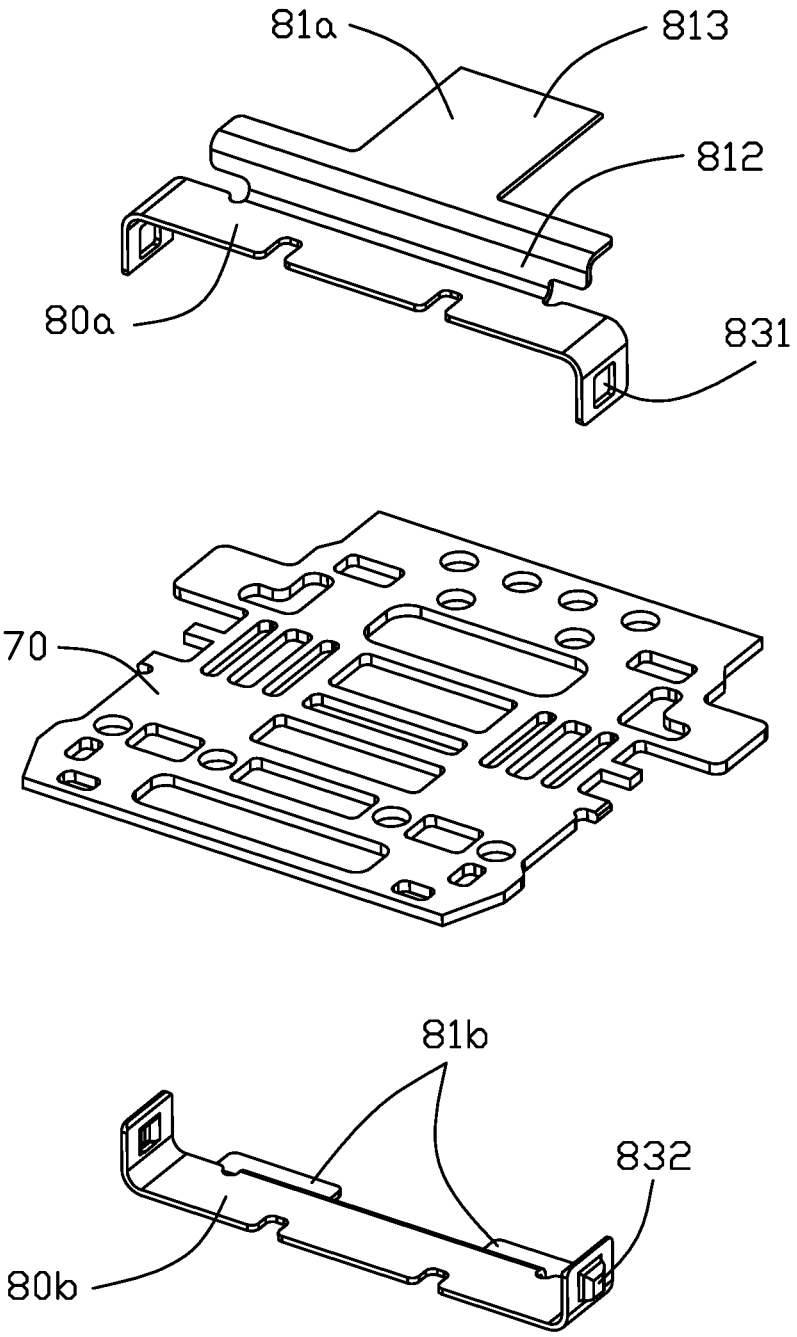
FIG. 10 is a perspective view of a metallic member and a shielding plate of the electrical connector of FIG. 7.
Figure 11:
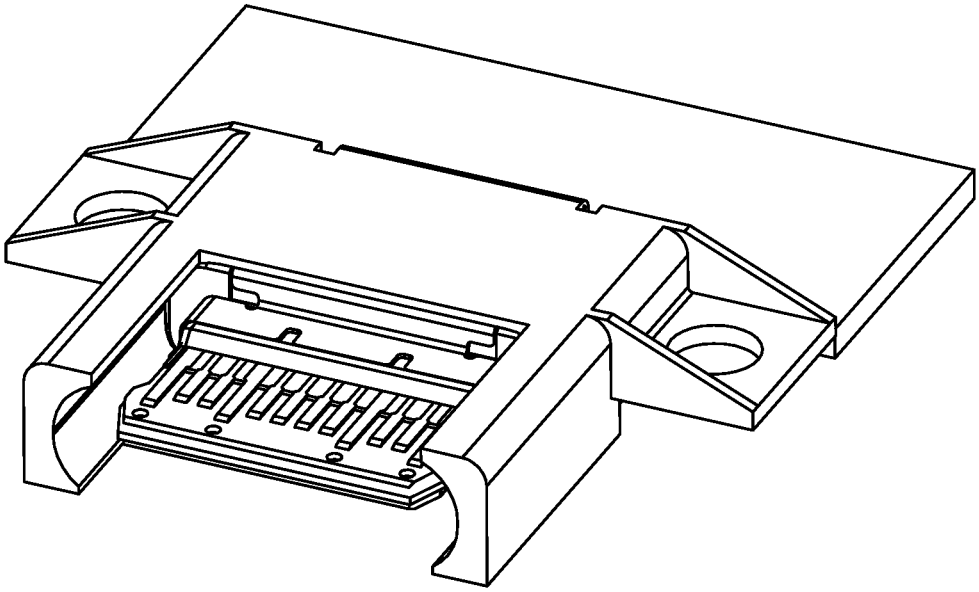
FIG. 11 is a perspective view of another embodiment of the electrical connector.

Referring to FIG. 7 and FIG. 8, the electrical connector 500 further includes a grounding member 80. The mating tongue 42 includes a root 424 extending forwardly from the base 41. The grounding member 80 surrounds the root 424. The grounding member 80 includes two extending taps 81 retained to the long-walls 613, 612 of the holding portion 61 (referring to FIG. 5) by a laser welding process. The grounding member 80 also contacts the shielding plate 70 in the transverse direction, and the grounding member 80 could be soldered to the shielding plate 70 in the transverse direction. The shielding plate 70 includes two stopping taps 72 adjacent to the lateral sides 71 respectively in the front-to-rear direction and neighboured to the root 424 of the mating tongue 42 to prevent an excessive insertion of a corresponding connector. The stopping taps 72 contact with the grounding member 80 in the front-to-rear direction. Referring to FIG. 10, the grounding member 80 includes an upper grounding member 80*a* and a lower grounding member 80*b*. The upper grounding member 80*a* includes two holes 831 located at two lateral sides thereof. The lower grounding member 80*b* includes two protruding bumps 832 at two lateral sides thereof. The two protruding bumps 832 of the lower grounding member 80*b* are inserted into the holes 831 of the upper grounding member 80*a*, and the upper grounding member 80*a* and the lower grounding member 80*b* can be mounted with each other tightly. On the other hand, the upper grounding member 80*a* could include two protruding bumps while the lower grounding member includes two corresponding holes. The upper grounding member 80*a* includes an upper extending tap 81*a* while the lower grounding member 80*b* includes a lower extending tap 81*b*. The upper extending tap 81*a* includes a connecting portion 812 extending from the upper grounding member 80*a* and an extending portion 813 extending from the connecting portion 812. The width of the connecting portion 812 is larger than the width of the extending portion 813. The lower extending tap 81*b* includes two pieces extending backwardly from the lower grounding member 80*b*. Referring to FIG. 6, the holding portion 61 of the shell includes two grooves 6123 corresponding to the two pieces of the lower extending taps 81*b*. The two pieces of the lower extending taps 81*b* are retained in the two grooves 6123 respectively and soldered to the two grooves 6123.

The detailed structures and manufacturing methods of the insulative housing 40, shielding plate 70 and grounding member 80 would not be introduced anymore. Please refer to U.S. patent application Ser. No. 15/263,345, if you want to know the detailed structures and manufacturing methods of the insulative housing 40, shielding plate 70 and grounding member 80.

Figure 12:
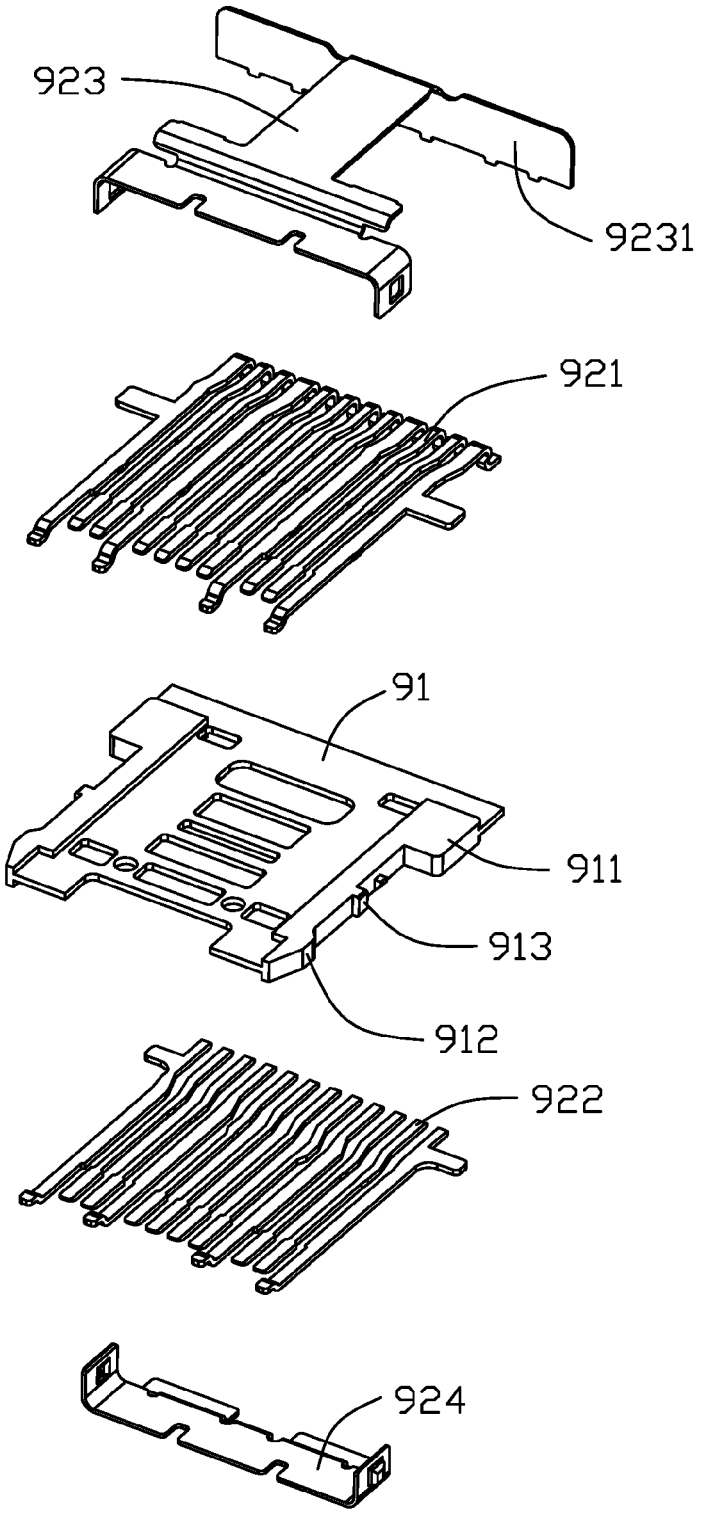
FIG. 12 is a perspective view of a metallic member and a shielding plate of another embodiment of the electrical connector of the present invention.
Figure 13:
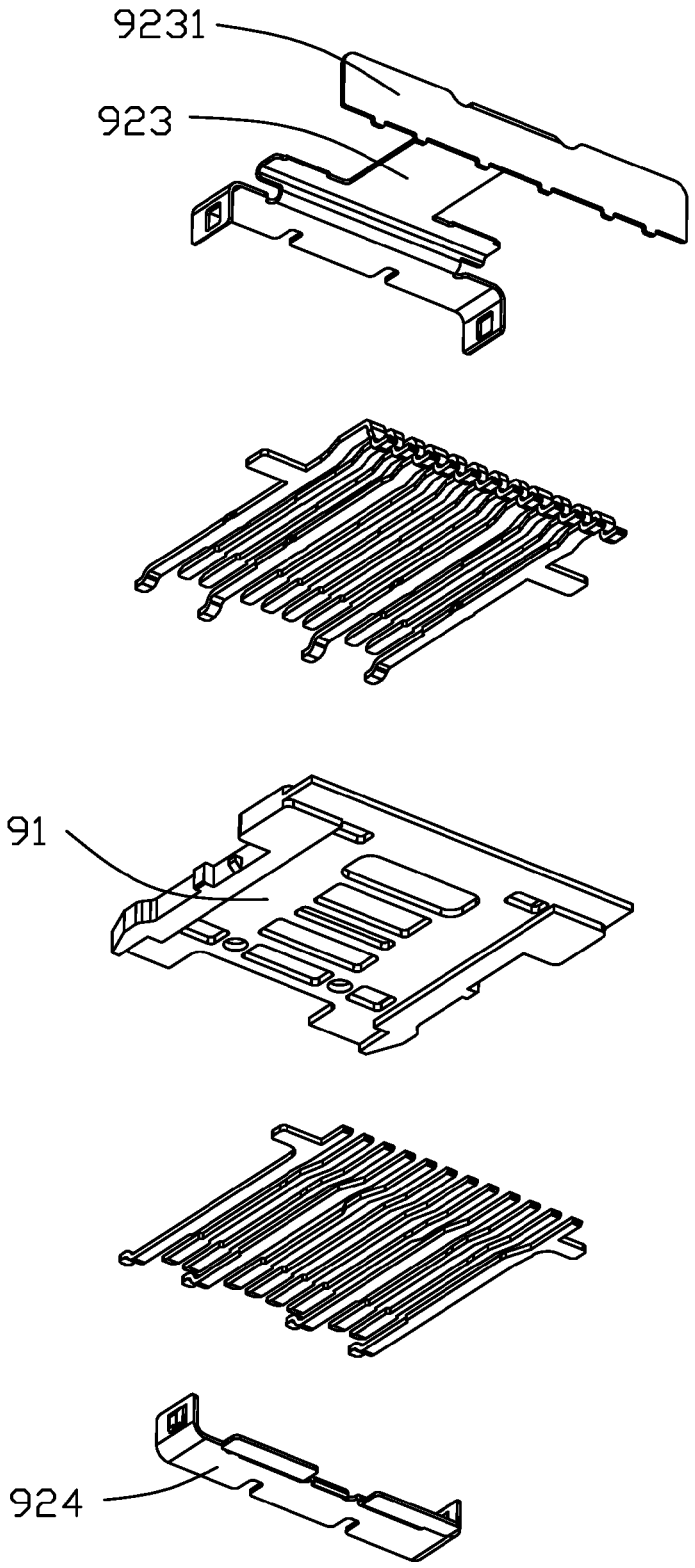
FIG. 13 is another perspective view of FIG. 12.

FIG. 12 and FIG. 13 show another embodiment of the present invention. The shielding plate 91 includes two thickened portions 911 located at two opposite sides thereof in the transverse direction, two lateral sides 912 extending from the thickened portions 911 respectively, and two stopping taps 913 extending from the thickened portions 911. The upper grounding member 923 includes a rear portion 9231 extending downwardly from the extending tap. The rear portion 9231 covers the rear surface of the insulative housing. The shell 60 could not need the rear wall 615 because of the rear portion 9231 of the upper grounding member 923.

Figure 14:
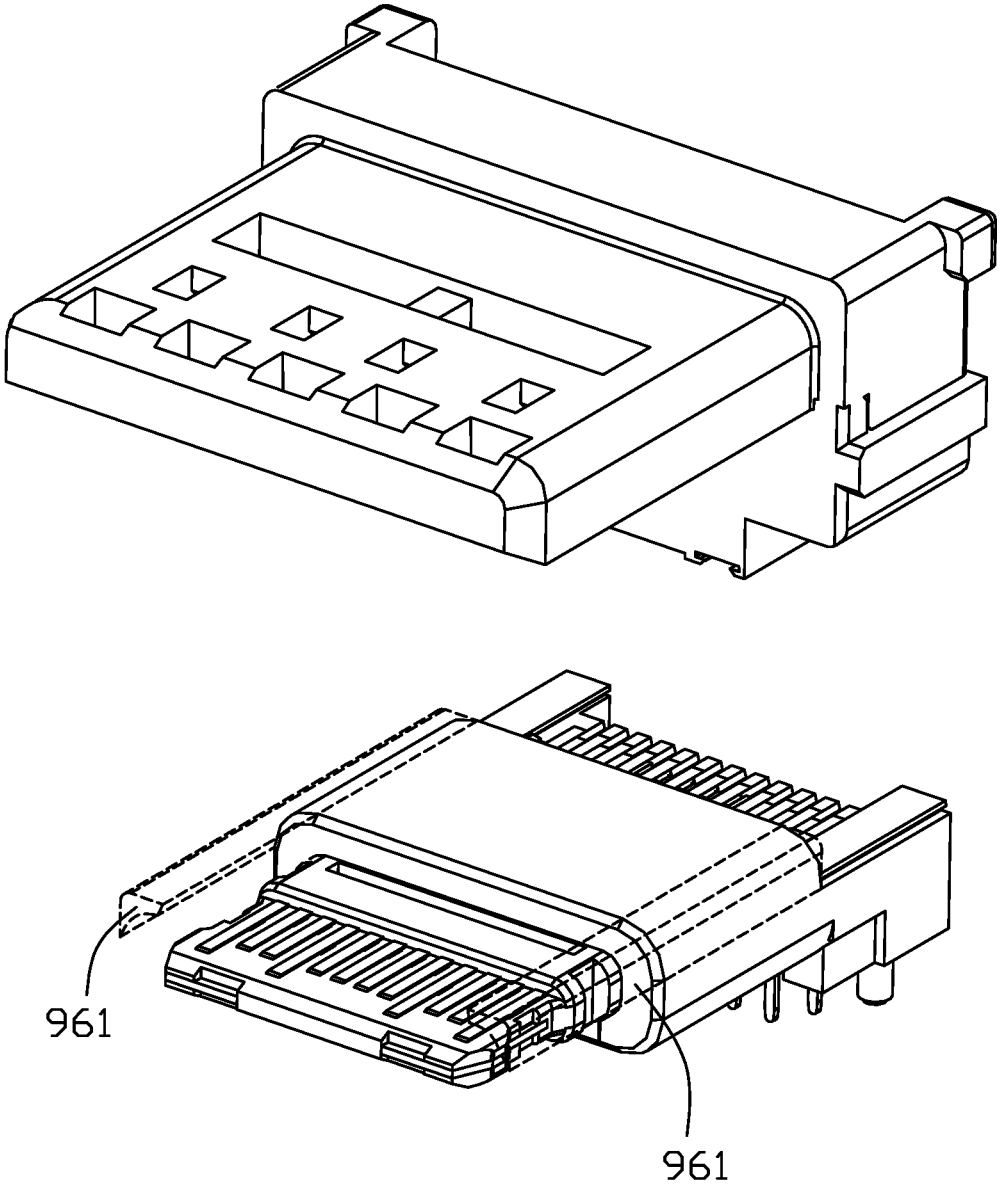
FIG. 14 is a perspective view of an insulative housing of another embodiment of the electrical connector of the present invention.
Figure 15:
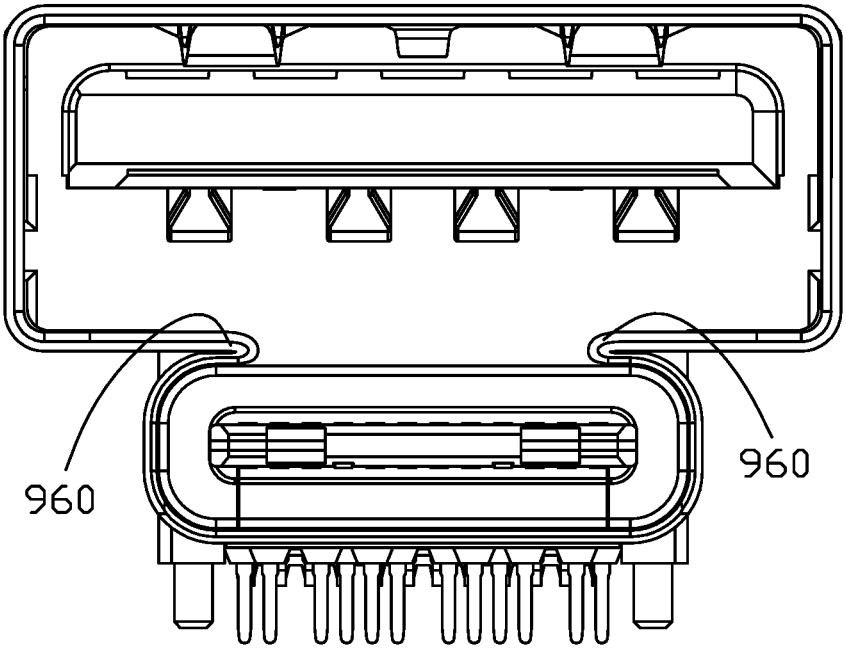
FIG. 15 is a perspective view of a stacked-type electrical connector of the present invention.
Figure 16:
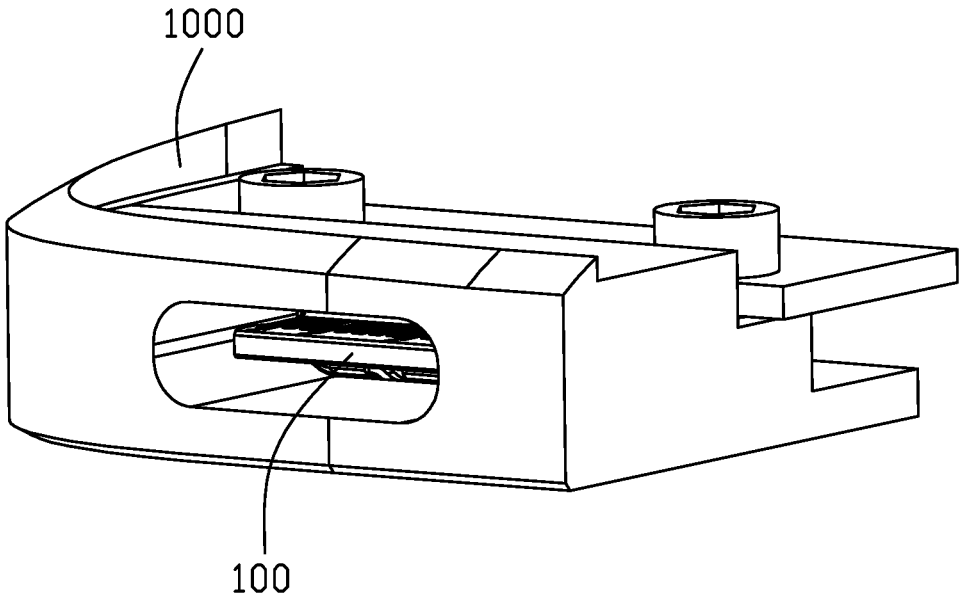
FIG. 16 is a perspective view of an electrical device of another embodiment of the present invention.
Figure 17:
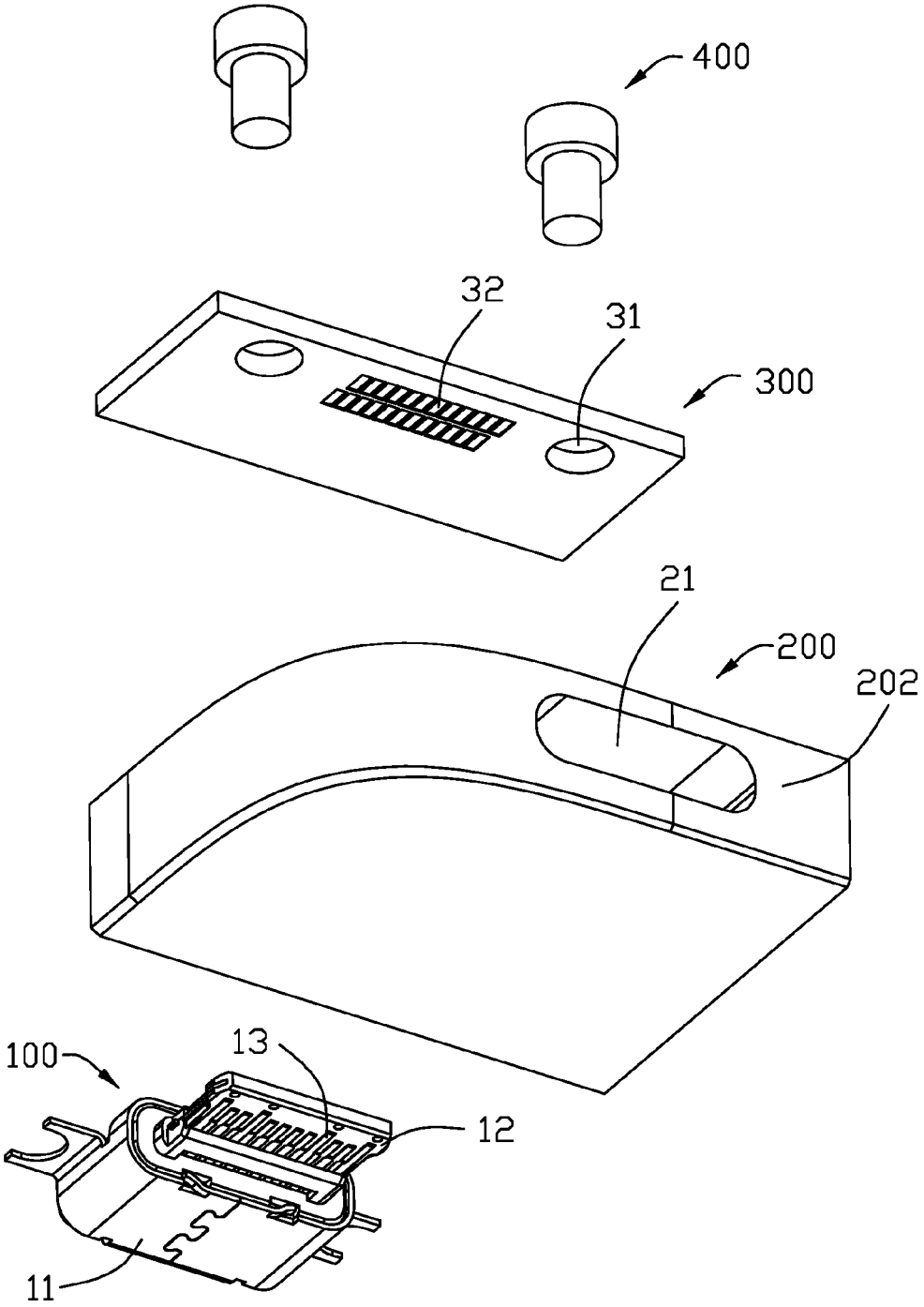
FIG. 17 is an exploded perspective view of the electrical device of FIG. 16.
Figure 18:
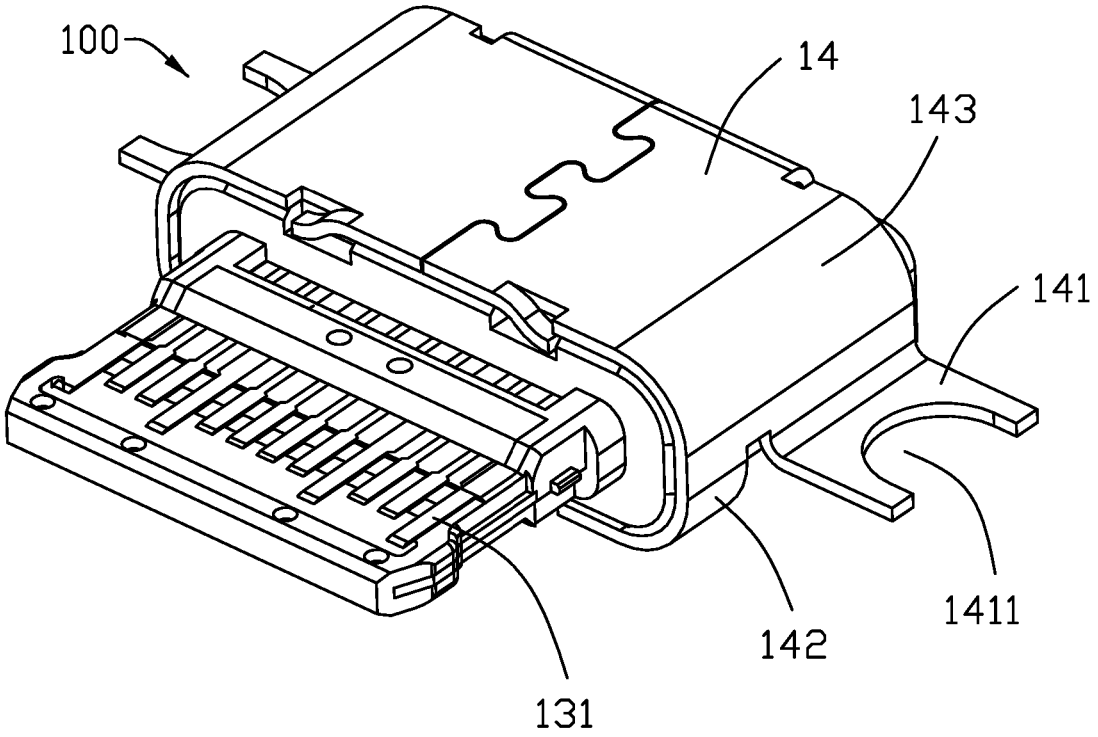
FIG. 18 is a perspective view of an electrical connector of the electrical device of FIG. 17.

Referring to FIG. 14, the insulative housing includes two ribs 961 extending forwardly therefrom. FIG. 15 shows a stacked-type electrical connector. The stack connector includes a metal shell with two protruding inner sides 960 covering parts of a lower connector of the stack electrical connector, and the two protruding inner sides 960 form a space for an upper connector of the stack electrical connector.

FIGS. 16 to 27 show another electrical device 1000 of the present invention. Referring to FIGS. 16 to 23, the electrical device 1000 includes a shell 200, a printed circuit board 300 and an electrical connector 100. The shell 200 includes an interior surface 201, an exterior surface 202 and a mating cavity 21 going through both of the interior surface 201 and the exterior surface 202. A part of the electrical connector 100 is received in the mating cavity 21. The electrical connector 100 includes a base 11, a mating tongue 12 extending forwardly from the base 11 and a plurality of terminals 13. Each of the terminals 13 includes a connecting section 131 exposed on the mating tongue 12 and a tail extending outside of the base 11. The mating tongue 12 is received in the mating cavity 21 of the shell 200. The mating tongue 12 and the mating cavity 21 of the shell define a space for a corresponding connector inserting therein. The base 11 is exposed in the shell 200 and includes a mating surface 111. The electrical device 1000 includes two bolts 400 to mount the shell 200 to the printed circuit board 300 tightly.

The connecting sections 131 of the terminals 13 are arranged in two rows in a transverse direction and exposed on two opposite surfaces of the mating tongue 12, respectively. The tails 132 of the terminals 13 are arranged in two rows in a front-to-rear direction perpendicular to the transverse direction. The base 11 includes a middle portion 112 corresponding to the mating cavity 21 and a rear portion 113 defining the mating surface 111. Each of the tails 132 includes a contacting section 1321 bending therefrom and protruding to the mating surface 111. The electrical connector 100 includes a metal shell 14 surrounding around the base 11, and an interior surface of the metal shell 14 contacts with an exterior surface of the base 11. The metal shell 14 includes a front portion 142 surrounding around the middle portion 112 of the base 11 and a rear portion 143 surrounding around the rear portion 113 of the base 11. The metal shell 14 includes a pair of mounting taps 141 extending transversely from the rear portion 143 of the shell 14. The mounting taps 141 of the shell 14 are coplanar with the mating surface 111 of the base 11. Each of the mounting taps 141 includes a third mounting hole 1411.

Figure 19:
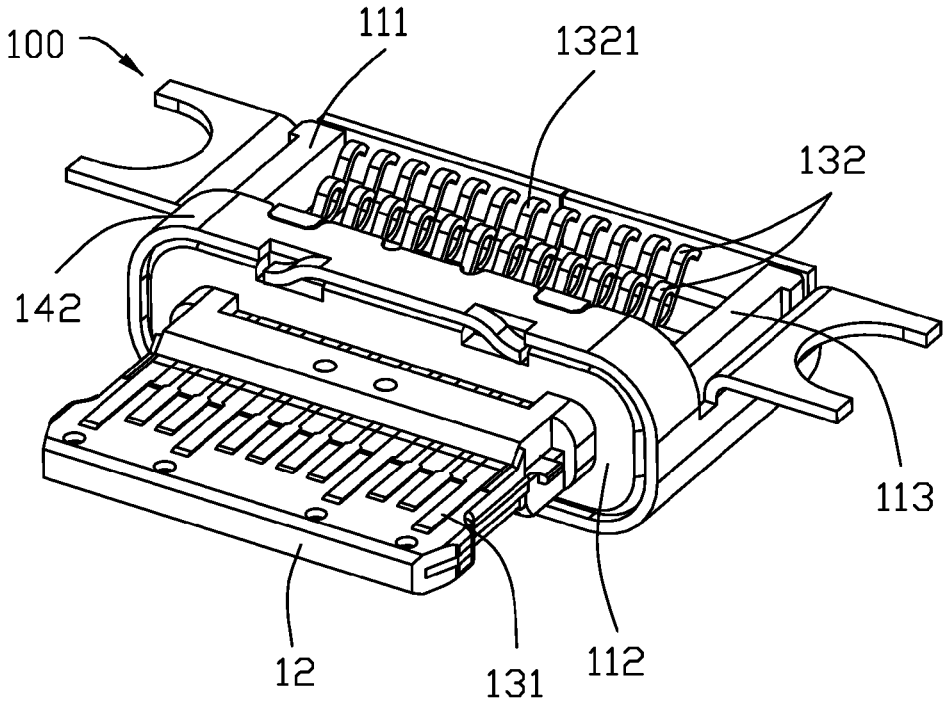
FIG. 19 is another perspective view of FIG.18.
Figure 20:
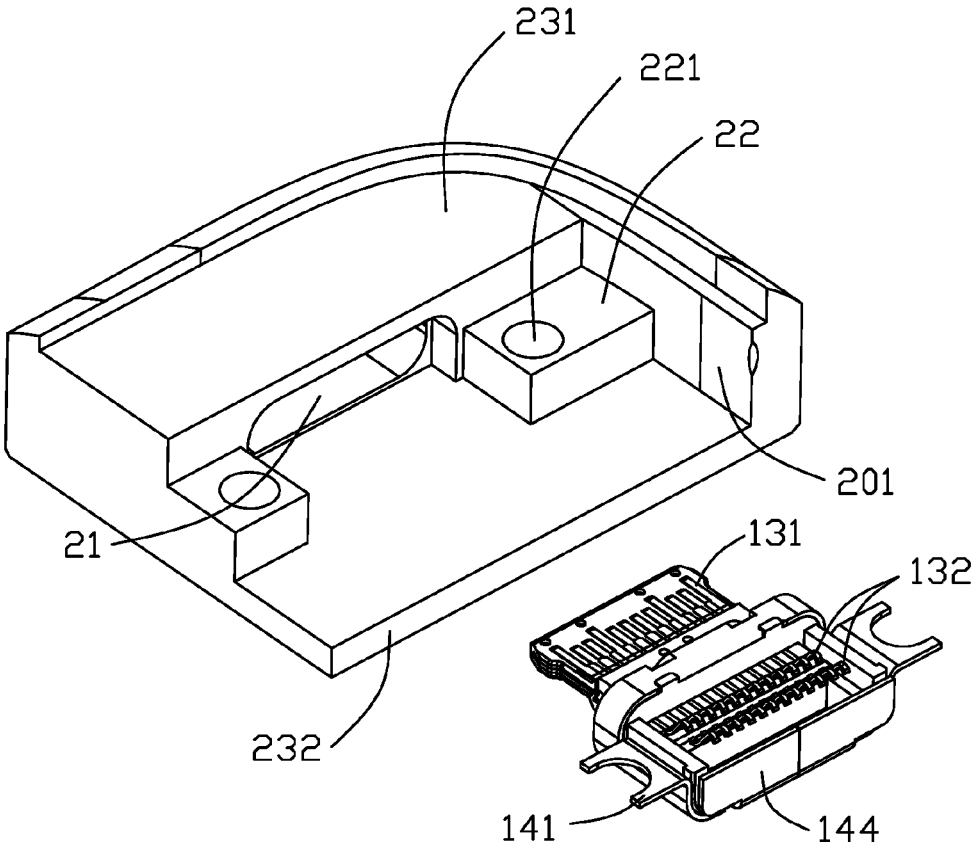
FIG. 20 is a perspective view of the shell and the electrical connector of FIG. 17.
Figure 21:
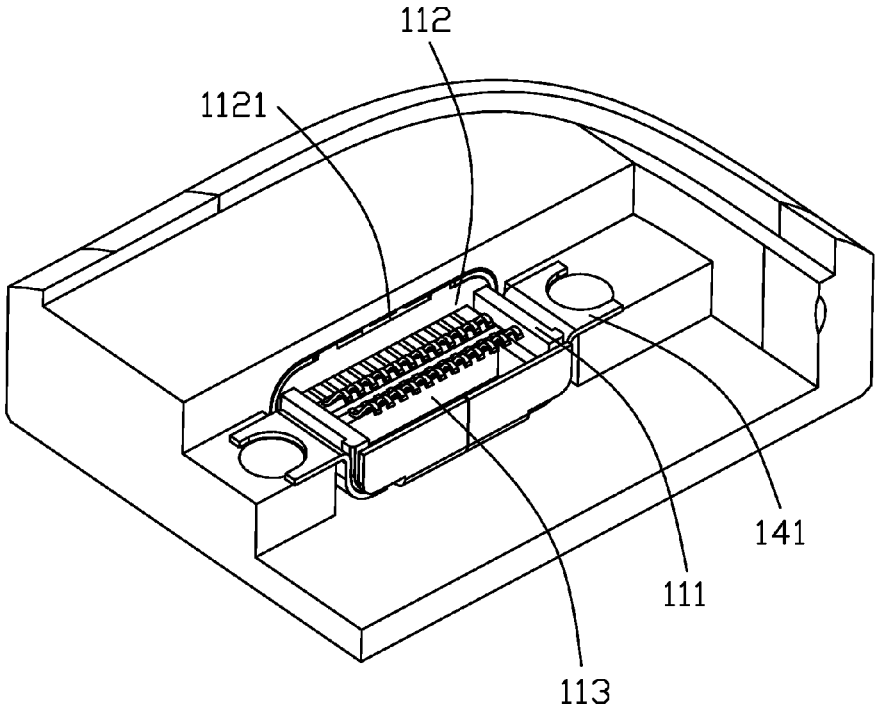
FIG. 21 is a perspective view of the electrical connector mounted to the shell of FIG. 20.
Figure 22:
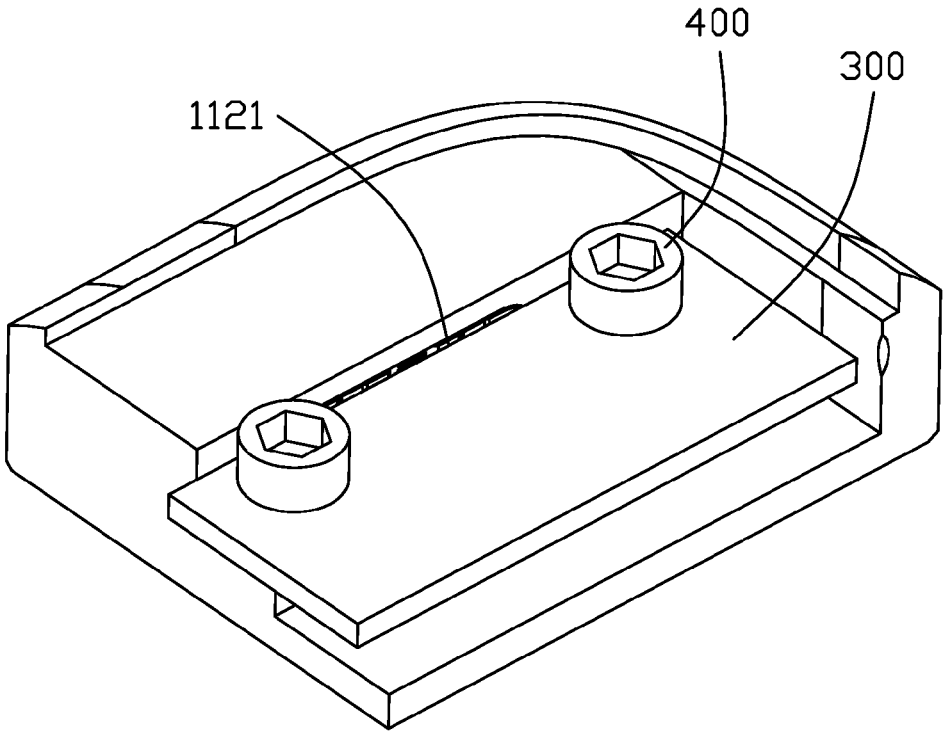
FIG. 22 is another perspective view of FIG. 16.
Figure 23:
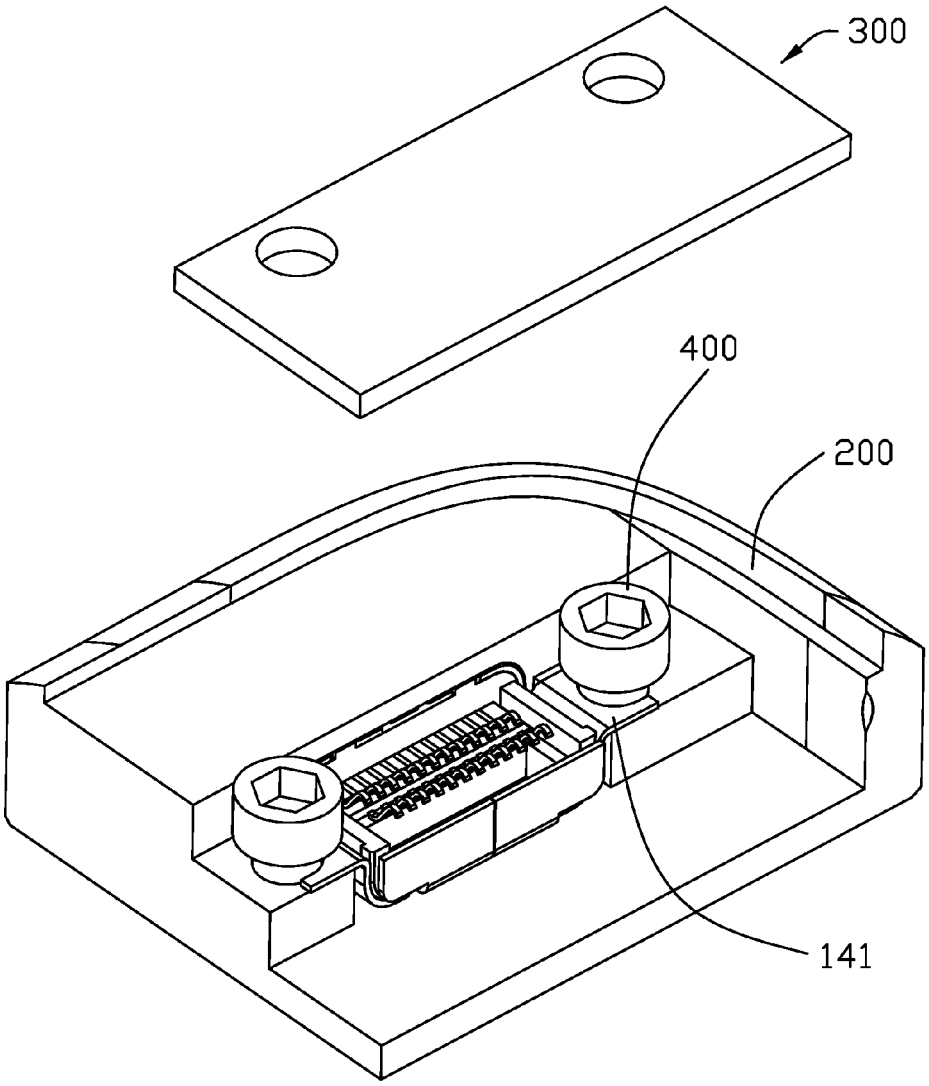
FIG. 23 is an exploded perspective view of FIG. 22.

FIGS. 20 to 22 show the method of the electrical device 1000. Referring to FIG. 20, the cavity 21 with a capsular cross-sectional configuration is similar to USB Type C connector. The shell 200 includes two protruding/supporting portions 22 at the lateral sides of the mating cavity 21. Each of the protruding portions 22 includes a first mounting hole 221. The shell 200 includes a side wall 231 and a lower wall 232 connecting with the side wall 231. The mating cavity 21 goes through the side wall 231 in the front-to-rear direction. The electrical connector 100 is inserted into the mating cavity 21 along the interior surface 201. Referring to FIG. 19, the middle portion 112 is received in the mating cavity 21. Each of the mounting taps 141 is mounted on an upper surface of the protruding potion 22 while the third mounting hole 1411 aligns to the first mounting hole 221. Then, the printed circuit board 300 is mounted on the mating surface 111 of the electrical connector 100. The printed circuit board 300 includes a second mounting hole 31. The mounting taps 141 are located between the printed circuit board 300 and the protruding portions 22. The bolts 400 go through both of the second and third mounting holes 31, 1411 and mounted to the first mounting hole 221 to joint the printed circuit board 300 and the shell 200 tightly. The printed circuit board 300 includes a plurality of pads 32 corresponding to the tails 132 of the terminals 13 and electrically connecting with the tails 132 of the terminals 13. The middle portion 112 includes an upper surface 1121 and a lower surface opposite thereto. The mating surface 111 is located between the upper surface 1121 and the lower surface in the vertical direction. When the printed circuit board 300 is mounted to the shell 200, the height of the printed circuit board 300 is smaller than the height of the middle portion 112 of the base 11 to reduce the whole height.

Figure 24:
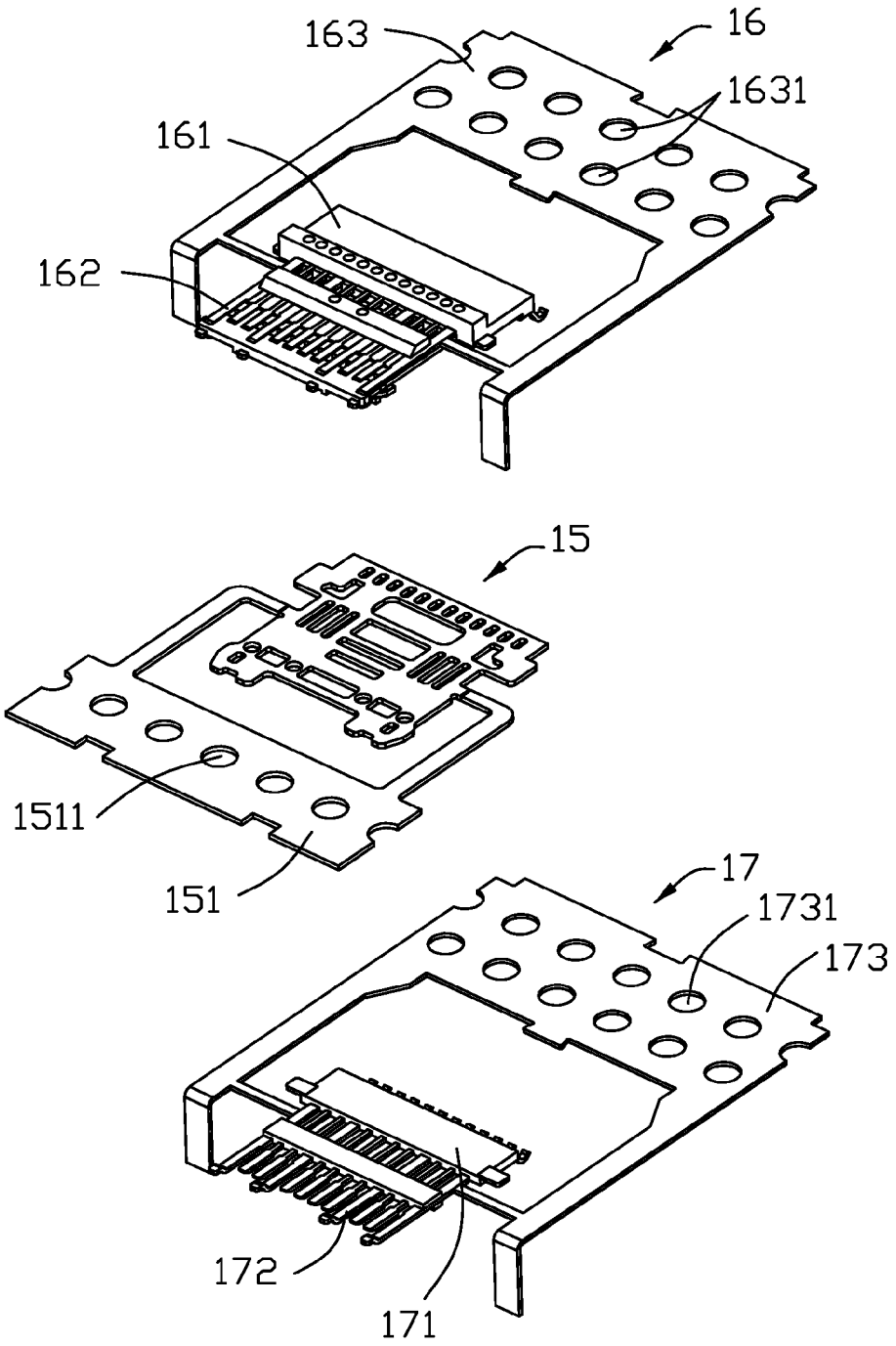
FIG. 24 is a perspective view of a shielding plate, a first terminal module and a second terminal module with strips of the electrical connector.
Figure 25:
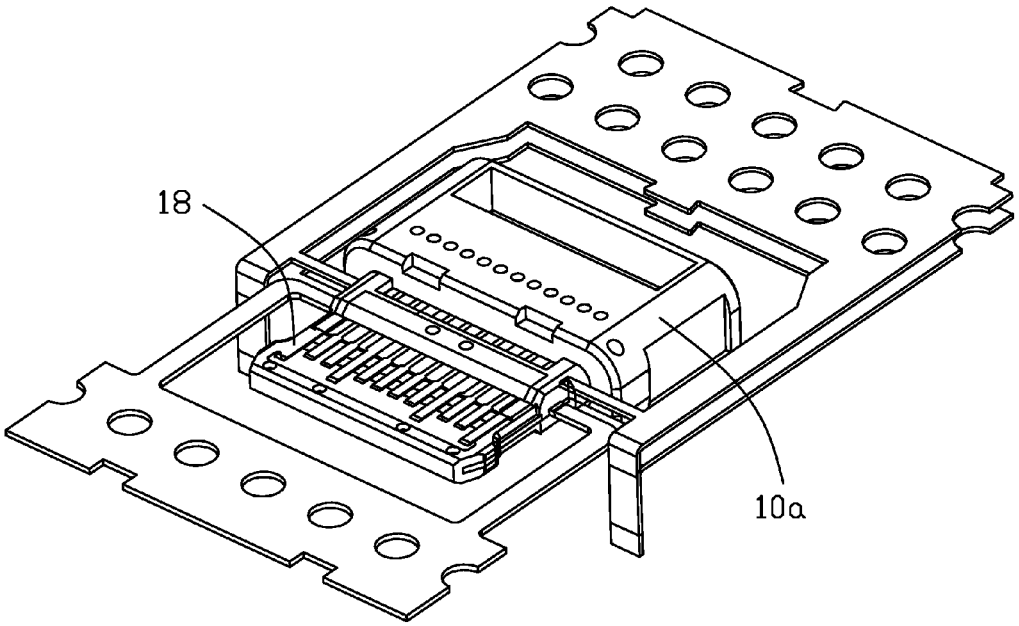
FIG. 25 is a perspective view of a terminal module with the strips of the electrical connector.
Figure 26:
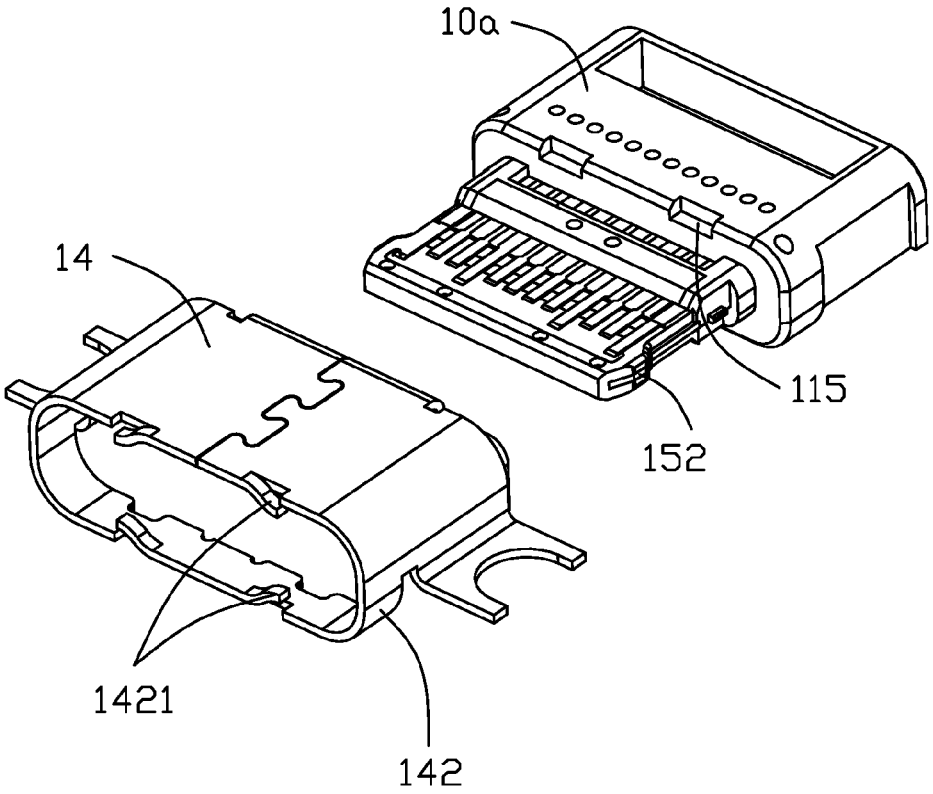
FIG. 26 is an exploded perspective view of the electrical connector of FIG. 18.
Figure 27:
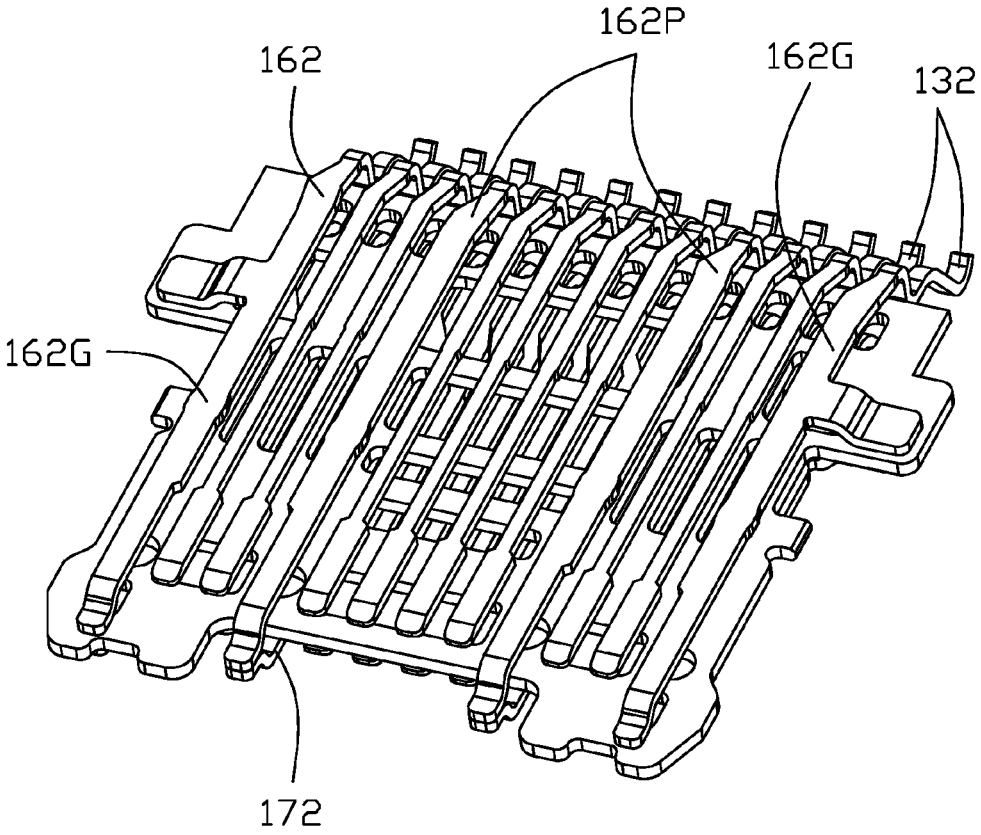
FIG. 27 is a perspective view of the first terminals, the second terminals and the shielding plate of the electrical connector.

FIGS. 24 to 26 show the manufacturing method of the electrical connector 100. Firstly, provide a shielding plate 15, a first terminal module 16 and a second terminal module 17. The shielding plate 15 includes a first strip 151 with a plurality of first holes 1511. The first terminal module 16 includes a first insulative housing 161, a plurality of first terminals 162 retained in the first insulative housing 161, and a second strip 163 connecting with the first terminals 162. The second strip 163 includes a plurality of second holes 1631. The second terminal module 17 includes a second insulative housing 171, a plurality of second terminals 172 retained in the second insulative housing 171, and a third strip 173 connecting with the second terminals 172. The third strip 173 includes a plurality of second holes 1731. A third insulative housing 18 is disposed to surround around the first terminal module 16, the shielding plate 15 and the second terminal module 17 by a way of over-molding. Remove all of the strips. Assemble a metal shell 14 to enclose the terminal module 10*a*. The terminal module 10*a* includes a plurality of grooves 115. Referring to FIG. 20, the metal shell 14 includes a rear wall 144 and a plurality of elastic members 1421 corresponding to the grooves 115 of the terminal module 10*a*. Referring to FIG. 27, the terminals include a plurality of power terminals 162P, a plurality of grounding terminals 162G and the other terminals. The width of the power terminal 162P and the grounding terminal 162G is bigger than the width of the other terminals.

However, the disclosure is illustrative only, changes may be made in detail, especially in matter of shape, size, and arrangement of sections within the principles of the invention.

What is claimed is:

1. An electrical connector for receiving a complementary plug connector therein, comprising:

an insulative housing comprising a base and a mating tongue extending forwardly from the base in a front-to-back direction, the mating tongue comprising two opposite mating faces in a vertical direction perpendicular to said front-to-back direction, and two side faces connecting therebetween in a transverse direction perpendicular to both said front-to-back direction and said transverse direction;

a plurality of terminals retained in the insulative housing, each of the terminals comprising a contacting section exposed on the mating face and a tail extending out of the base; and a metallic shell forming a receiving space surrounding the insulative housing, the shell comprising a holding portion retained to the base and a mating portion extending along said front-to-rear direction; wherein the mating portion of the shell comprises two short-walls facing to the two side faces of the mating tongue in the transverse direction, and at least one of the mating faces of the mating tongue is exposed to exterior in said vertical direction without any long-wall of said shell linked between said two short-walls in the transverse direction for shielding in the vertical direction so as to minimize a dimension of said mating portion in the vertical direction.

2. The electrical connector as claimed in claim 1, wherein the shell is not formed by a way of stamping but in a die-casting molding process, and each of the short-walls comprises an inwardly arcuate interior surface so as to restrict movement of the complementary plug in the vertical direction during mating.

3. The electrical connector as claimed in claim 2, wherein a connecting surface between the two vertical ends of the two short-walls, in the vertical direction, complies with an exterior surface of said complementary plug connector during mating.

4. The electrical connector as claimed in claim 2, wherein each of the short-walls forms a planar exterior surface in the vertical direction so as to have opposite vertical ends of each of the short-walls, in the vertical direction, form a larger thickness thereof than other portions of each of the short-walls.

5. The electrical connector as claimed in claim 2, wherein said shell further includes only one long-wall.

6. The electrical connector as claimed in claim 5, wherein a thickness of the long-wall of the shell is smaller than that of the short-wall of the shell.

7. The electrical connector as claimed in claim 5, wherein the holding portion of the shell comprises two short-walls and two long-walls, and a front face of the long-wall is coplanar with a front face of the base in the vertical direction.

8. The electrical connector as claimed in claim 5, wherein the holding portion of the shell comprises an upper long-wall and a lower long-wall, and an exterior surface of the upper long-wall of the shell is coplanar with an exterior surface of the long-wall of the mating portion.

9. The electrical connector as claimed in claim 5, wherein the holding portion comprises a rear wall extending downwardly from a rear edge of the upper long-wall of the holding portion.

10. The electrical connector as claimed in claim 2, further comprises a grounding member and a shielding plate located between the two opposite mating feces of the mating tongue, the grounding member surrounds a root of the mating tongue neighboring to the base, the grounding member comprises two extending taps mounted on the long-wall of the holding portion of the shell, the ground member contacts with the shielding plate, and the shielding plate comprises two stopping taps adjacent to the grounding member.

11. An electrical device comprising:

a case comprising a mating space forwardly communicating with an exterior along a front-to-back direction;

a printed circuit board located in the case and behind the mating space in said front-to-back direction; and an electrical connector mounted on the printed circuit board including:

an insulative housing comprising a base and a mating tongue extending forwardly from the base, the mating tongue comprising two opposite mating faces in a vertical direction perpendicular to said front-to-back direction, and two side faces connecting therebetween in a transverse direction perpendicular to both said front-to-back direction and said vertical direction;

a plurality of terminals retained in the insulative housing, each of the terminals comprising a contacting section exposed on the mating face; and a shell forming a receiving space surrounding the insulative housing and comprising a holding portion retained to the base behind a front face of said base so as to expose substantially the whole mating tongue; wherein the mating tongue is inserted into and directly received and exposed in the mating space, and the holding portion forms a pair of mounting taps mounted to the case.

12. The electrical device as claimed in claim 11, wherein the printed circuit board cooperates with the case to sandwich the pair of mounting taps in the vertical direction.

13. The electrical device as claimed in claim 12, wherein the tail of the terminals are removeably pressed upon the printed circuit board in the vertical direction.

14. An electrical connector for receiving a complementary plug connector, comprising:

a terminal module including an insulative housing and a plurality of terminals retained therein, said housing including a base portion with a mating tongue extending forwardly from the base portion in a front-to-back direction, the mating tongue defining two opposite mating faces in a vertical direction perpendicular to said front-to-back direction, and two opposite side faces linked between the two opposite mating faces in the vertical direction and spaced from each other in a transverse direction perpendicular to both said front-to-back direction and said vertical direction;

a metallic shell formed by molding and having different thicknesses at different positions; wherein said shell includes a pair of short walls located outside of the corresponding side faces, respectively, in the transverse direction, and at most a long wall linked between the pair of short walls and facing one corresponding mating face of said mating tongue in the vertical direction so as to expose the other mating face in the vertical direction for minimizing, along the vertical direction, a vertical dimension of a mating portion which is formed between said pair of short walls and encloses the mating tongue.

15. The electrical connector as claimed in claim 14, wherein said pair of short walls forms a pair of inward arcuate interior faces so as to restrict the complementary plug connector in the vertical direction in the vertical direction.

16. The electrical connector as claimed in claim 15, wherein each of said short walls has a larger thickness in said transverse direction at opposite vertical ends than other portions thereof.

17. The electrical connector as claimed in claim 14, wherein said at most one long wall has a thickness smaller than that of each of said short walls.

18. The electrical connector as claimed in claim 14, wherein each of the terminals includes a tail for mounting to a printed circuit board which is adapted located on a side directly facing to said the mating face in the vertical direction.

19. The electrical connector as claimed in claim 14, wherein said shell has no long wall between said pair of short walls.

* * * * *